US005553191A

United States Patent [19]

Minde

[11] Patent Number: 5,553,191

[45] Date of Patent: Sep. 3, 1996

[54] DOUBLE MODE LONG TERM PREDICTION IN SPEECH CODING

[75] Inventor: Tor B. Minde, Gammelstad, Sweden

[73] Assignee: Telefonaktiebolaget LM Ericsson, Stockholm, Sweden

[21] Appl. No.: 9,245

[22] Filed: Jan. 26, 1993

[30] Foreign Application Priority Data

Jan. 27, 1992 [SE] Sweden ..... 9200217

[51] Int. Cl.[6] ..... G10L 9/00

[52] U.S. Cl. ..... 395/228; 395/2.3; 395/2.32

[58] Field of Search ..... 395/2, 2.28–2.32, 395/2.1, 2.2, 2.34; 381/36, 40, 37–39

[56] References Cited

U.S. PATENT DOCUMENTS

| | | | |
|---|---|---|---|
| 4,868,867 | 9/1989 | Davidson et al. | 395/2.32 |
| 4,932,061 | 6/1990 | Kroon et al. | 395/2.32 |
| 5,097,508 | 3/1992 | Valenzuela Stuede et al. | 381/36 |
| 5,199,076 | 3/1993 | Taniguchi et al. | 381/36 |
| 5,233,660 | 8/1993 | Chen | 395/2.31 |
| 5,271,089 | 12/1993 | Ozawa | 395/2.2 |
| 5,359,696 | 10/1994 | Gerson et al. | 395/2.32 |
| 5,414,796 | 5/1995 | Jacobs et al. | 395/2.3 |

OTHER PUBLICATIONS

Adavl et al., "Fast CELP Coding Based on Azgebrate Codes," ICASSP, Apr. 6–9, 1987, pp. 1957–60.

Schroeder et al., "Code–Excited Linear Prediction (CEL-P):High Quality Speech at Very Low Bit Rates" ICASSP, pp. 937–940, Mar. 1985.

Kroon et al., "Strategies for Improving SAE Performance of CELP Coders at Low Bit Rates" ICASSP, 1988, pp. 151–154.

P. Kabal et al., "Synthesis Filter Optimization and Coding: Applications to CELP" IEEE ICASSP–88, New York, 1988, pp. 147–150.

W. Kleijn et al., "Improved Speech Quality and Efficient Vector Quantization in SELP" IEEE ICASSP–88, New York, 1988, pp. 155–158.

P. Kroon et al., "On the Use of Pitch Predictors with High Temporal Resolution" IEEE Trans. on Signal Processing, vol. 39, No. 3, pp. 733–735 (Mar. 1991).

R. Ramachandran et al., "Pitch Prediction Filters in Speech Coding", IEEE Trans. on Acoustics, Speech, and Signal Processing, vol. 37, No. 4, pp. 467–478 (Apr. 1989).

*Primary Examiner*—Allen R. MacDonald
*Assistant Examiner*—Michael A. Sartori
*Attorney, Agent, or Firm*—Burns, Doane, Swecker & Mathis

[57] ABSTRACT

A method of coding a sampled speech signal vector in an analysis-by-synthesis coding procedure includes the step of forming an optimum excitation vector comprising a linear combination of a code vector from a fixed code book and a long term predictor vector. A first estimate of the long term predictor vector is formed in an open loop analysis. A second estimate of the-long term predictor vector is formed in a closed loop analysis. Finally, each of the first and second estimates are combined in an exhaustive search with each code vector of the fixed code book to form that excitation vector that gives the best coding of the speech signal vector.

9 Claims, 4 Drawing Sheets

DOUBLE MODE LONG TERM PREDICTION IN SPEECH CODING

TECHNICAL FIELD

The present invention relates to a method of coding a sampled speech signal vector in an analysis-by-synthesis method for forming an optimum excitation vector comprising a linear combination of code vectors from a fixed code book in a long term predictor vector.

BACKGROUND OF THE INVENTION

It is previously known to determine a long term predictor, also called "pitch predictor" or adaptive code book in a so called closed loop analysis in a speech coder (W. Kleijn, D. Krasinski, R. Ketchum "Improved speech quality and efficient vector quantization in SELP", IEEE ICASSP-88, New York, 1988). This can for instance be done in a coder of CELP type (CELP= Code Excited Linear Predictive coder). In this type of analysis the actual speech signal vector is compared to an estimated vector formed by excitation of a synthesis filter with an excitation vector containing samples from previously determined excitation vectors. It is also previously known to determine the long term predictor in a so called open loop analysis (R. Ramachandran, P. Kabal "Pitch prediction filters in speech coding", IEEE Trans. ASSP Vol. 37, No. 4, April 1989), in which the speech signal vector that is to be coded is compared to delayed speech signal vectors for estimating periodic features of the speech signal.

The principle of a CELP speech coder is based on excitation of an LPC synthesis filter (LPC=Linear Predictive Coding) with a combination of a long term predictor vector from some type of fixed code book. The output signal from the synthesis filter shall match as closely as possible the speech signal vector that is to be coded. The parameters of the synthesis filter are updated for each new speech signal vector, that is the procedure is frame based. This frame based updating, however, is not always sufficient for the long term predictor vector. To be able to track the changes in the speech signal, especially at high pitches, the long term predictor vector must be updated faster than at the frame level. Therefore this vector is often updated at subframe level, the subframe being for instance ¼ frame.

The closed loop analysis has proven to give very good performance for short subframes, but performance soon deteriorates at longer subframes.

The open loop analysis has worse performance than the closed loop analysis at short subframes, but better performance than the closed loop analysis at long subframes. Performance at long subframes is comparable to but not as good as the closed loop analysis at short subframes.

The reason that as long subframes as possible are desirable, despite the fact that short subframes would track changes best, is that short subframes implies a more frequent updating, which in addition to the increased complexity implies a higher bit rate during transmission of the coded speech signal.

Thus, the present invention is concerned with the problem of obtaining better performance for longer subframes. This problem comprises a choice of coder structure and analysis method for obtaining performance comparable to closed loop analysis for short subframes.

One method to increase performance would be to perform a complete search over all the combinations of long term predictor vectors and vectors from the fixed code book. This would give the combination that best matches the speech signal vector for each given subframe. However, the complexity that would arise would be impossible to implement with the digital signal processors that exist today.

SUMMARY OF THE INVENTION

Thus, an object of the present invention is to provide a new method of more optimally coding a sampled speech signal vector also at longer subframes without significantly increasing the complexity.

In accordance with the invention this object is solved by (a) forming a first estimate of the long term predictor vector in an open loop analysis;

(b) forming a second estimate of the long term predictor vector in a closed loop analysis; and (c) in an exhaustive search linearly combining each of the first and second estimates with all of the code vectors in the fixed code book for forming that excitation vector that gives the best coding of the speech signal vector.

BRIEF DESCRIPTION OF THE DRAWINGS

The invention, together with further objects and advantages thereof, may best be understood by making reference to the following description taken together with the accompanying drawings, in which.

PREFERRED EMBODIMENTS

The same reference designations have been used for corresponding elements throughout the different figures of the drawings.

Figure 1:
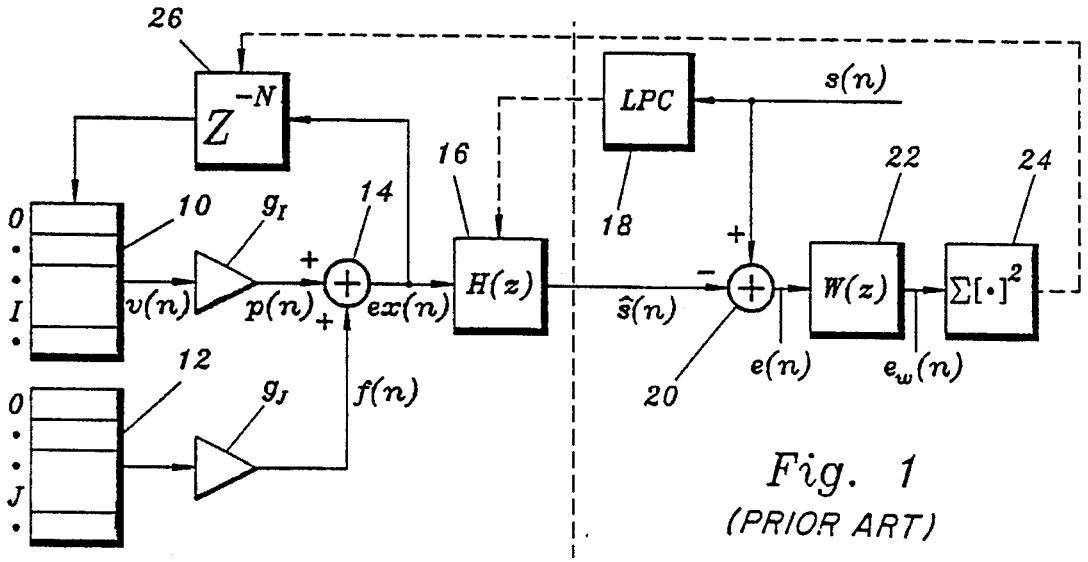
Fig. 1 (PRIOR ART)
FIG. 1 shows the structure of a previously known speech coder for closed loop analysis.

FIG. 1 shows the structure of a previously known speech coder for closed loop analysis. The coder comprises a synthesis section to the left of the vertical dashed centre line. This synthesis section essentially includes three parts, namely an adaptive code book 10, a fixed code book 12 and an LPC synthesis filter 16. A chosen vector from the adaptive code book 10 is multiplied by a gain factor $g_l$ for forming a signal p(n). In the same way a vector from the fixed code book is multiplied by a gain factor $g_f$ for forming a signal f(n). The signals p(n) and f(n) are added in an adder 14 for forming an excitation vector ex(n), which excites the synthesis filter 16 for forming an estimated speech signal vector $\hat{s}(n)$.

The estimated vector is subtracted from the actual speech signal vector s(n) in an adder 20 in the right part of FIG. 1, namely the analysis section, for forming an error signal e(n). This error signal is directed to a weighting filter 22 for forming a weighted error signal $e_w(n)$. The components of this weighted error vector are squared and summed in a unit 24 for forming a measure of the energy of the weighted error vector.

The object is now to minimize this energy, that is to choose that combination of vector from the adaptive code book 10 and gain $g_I$ and that vector from the fixed code book 12 and gain $g_J$ that gives the smallest energy value, that is which after filtering in filter 16 best approximates the speech signal vector s(n). This optimization is divided into two steps. In the first step it is assumed that f(n)=0 and the best vector from the adaptive code book 10 and the corresponding $g_I$ are determined. When these parameters have been established that vector and that gain vector $g_J$ that together with the newly chosen parameters minimize the energy (this is sometimes called "one at a time" method) are determined.

The best index I in the adaptive code book 10 and the gain factor $g_I$ are calculated in accordance with the following formulas:

| | |
|---|---|
| $ex(n)=p(n)$ | Excitation vector($f(n)=0$) |
| $p(n)=g_i\cdot a_i(n)$ | Scaled adaptive code book vector |
| $\hat{s}(n)=h(n)*p(n)$ | Synthetic speech (* = convolution) |
| $e(n)=s(n)-\hat{s}(n)$ | Error vector |
| $e_w(n)=w(n)*(s(n)-\hat{s}(n))$ | Weighted error |
| $E=\Sigma\,[e_w(n)]^2\ n=0\ldots N-1$ | Squared weighted error |
| $N=40(t\ ex)$ | Vector length |
| $s_w(n)=w(n)*s(n)$ | Weighted speech |
| $h_w(n)=w(n)*h(n)$ | Weighted impulse response for synthesis filter |
| $\min E_i=\min\sum_{n=0}^{N-1}[e_{w_i}(n)]^2$ | Search optimal index in the adaptive code book |
| $\frac{\partial E_i}{\partial g_i}=0\rightarrow g_i=\frac{\sum_{n=0}^{N-1}s_w(n)\cdot a_i(n)*h_w(n)}{\sum_{n=0}^{N-1}[\hat{s}_{w_i}(n)]^2}$ | Gain for index $i$ |

The filter parameters of filter 16 are updated for each speech signal frame by analysing the speech signal frame in an LPC analyser 18. The updating has been marked by the dashed connection between analyser 18 and filter 16. In a similar way there is a dashed line between unit 24 and a delay element 26. This connection symbolizes an updating of the adaptive code book 10 with the finally chosen excitation vector ex(n).

Figure 2:
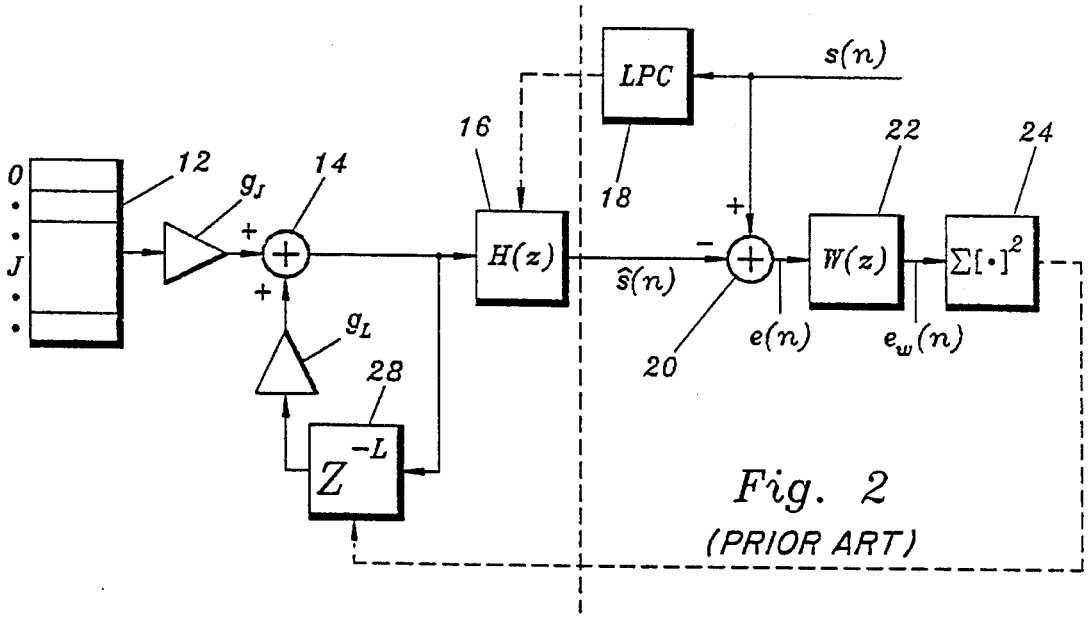
Fig. 2 (PRIOR ART)
FIG. 2 shows the structure of another previously known speech coder for closed loop analysis.

FIG. 2 shows the structure of another previously known speech coder for closed loop analysis. The right analysis section in FIG. 2 is identical to the analysis section of FIG. 1. However, the synthesis section is different since the adaptive code book 10 and gain element $g_I$ have been replaced by a feedback loop containing a filter including a delay element 28 and a gain element $g_L$. Since the vectors of the adaptive code book comprise vectors that are mutually delayed one sample, that is they differ only in the first and last components, it can be shown that the filter structure in FIG. 2 is equivalent to the adaptive code book in FIG. 1 as long as the lag L is not shorter that the vector length N.

For a lag L less that the vector length N one obtains for the adaptive code book in FIG. 1:

| | | |
|---|---|---|
| $v_p(n)$ | $n=-\text{Maxlag}\ldots-1$ | Long term memory (adaptive code book) |
| $v(n)=\begin{cases}v_p(n) & n=0\ldots L-1\\ 0 & n=L\ldots N-1\end{cases}$ | | Extraction of vector |
| $v(n)=v(n-L)$ | $n=L\ldots N-1$ | Cyclic repetition |

that is, the adaptive code book vector, which has the length N, is formed by cyclically repeating the components 0 . . . L−1. Furthermore, $$p(n)=g_I\cdot v(n)\qquad n=0\ldots N-1$$
$$ex(n)=p(n)+f(n)\qquad n=0\ldots N-1$$

where the excitation vector ex(n) is formed by a linear combination of the adaptive code book vector and the fixed code book vector.

For a lag L less than the vector length N the following equations hold for the filter structure in FIG. 2:

| | |
|---|---|
| $v(n)=g_L\cdot v(n-L)+f(n)$ | $n=0\ldots L-1$ |
| $v(n)=g_L^2\cdot v(n-2L)+g_L\cdot f(n-L)+f(n)$ | $n=L\ldots N-1$ |
| $ex(n)=v(n)$ | |

that is, the excitation vector ex(n) is formed by filtering the fixed code book vector through the filter structure $g_L$, 28.

Both structures in FIG. 1 and FIG. 2 are based on a comparison of the actual signal vector s(n) with an estimated signal vector ŝ(n) and minimizing the weighted squared error during calculation of the long term predictor vector.

Figure 3:
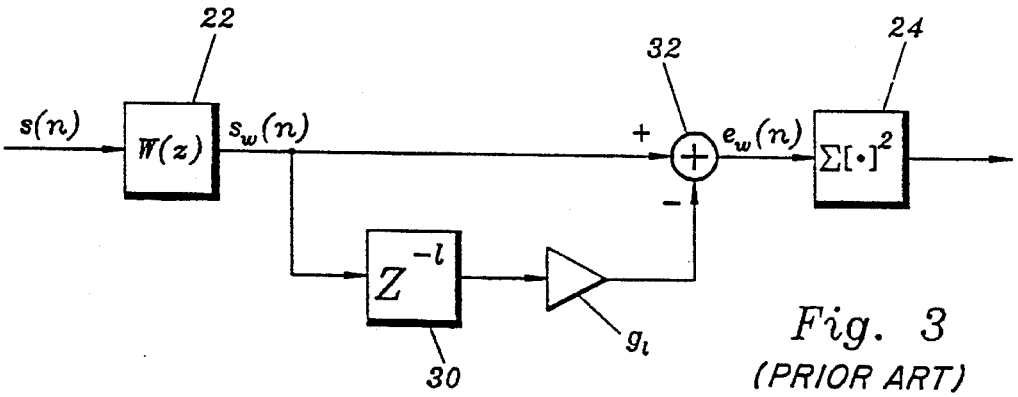
Fig. 3 (PRIOR ART)
FIG. 3 shows a previously known structure for open loop analysis.

Another way to estimate the long term predictor vector is to compare the actual speech signal vector s(n) with time delayed versions of this vector (open loop analysis) in order to discover any periodicity, which is called pitch lag below. An example of an analysis section in such a structure is shown in FIG. 3. The speech signal s(n) is weighted in a filter 22, and the output signal $s_w(n)$ of filter 22 is directed directly to and also over a delay loop containing a delay filter 30 and a gain factor $g_l$ to a summation unit 32, which forms the difference between the weighted signal and the delayed signal. The difference signal $e_w(n)$ is then directed to a unit 24 that squares and sums the components.

The optimum lag L and gain $g_L$ are calculated in accordance with:

| | |
|---|---|
| $e_w(n)=s_w(n)-g_l\cdot s_w(n-1)$ | Weighted error vector |
| $E=\Sigma\,[e_w(n)]^2\ n=0\ldots N-1$ | Squared weighted error |
| $\min E_l=\min\sum_{n=0}^{N-1}[s_w(n)-g_l\cdot s_w(n)]^2$ | Search for optimum lag $l$ |
| $\frac{\partial E_l}{\partial g_l}=0\rightarrow g_l=\frac{\sum_{n=0}^{N-1}s_w(n)\cdot s_w(n-1)}{\sum_{n=0}^{N-1}[s_w(n-1)]^2}$ | Gain for lag $l$ |

The closed loop analysis in the filter structure in FIG. 2 differs from the described closed loop analysis for the adaptive code book in accordance with FIG. 1 in the case where the lag L is less than the vector length N.

For the adaptive code book the gain factor was obtained by solving a first order equation. For the filter structure the gain factor is obtained by solving equations of higher order (P. Kabal, J. Moncet, C. Chu "Synthesis filter optimization and coding: Application to CELP", IEE ICASSP-88, New York, 1988).

For a lag in the interval N/2<L<N and for f(n)=0 the equation:

$$ex(n)=\begin{cases} g_L v(n-L) & n=0\ldots L-1 \\ g_L^2 v(n-2L) & n=L\ldots N-1 \end{cases}$$

is valid for the excitation ex(n) in FIG. 2. This excitation is then filtered by synthesis filter 16, which provides a synthetic signal that is divided into the following terms:

$$\hat{s}(n)=\hat{s}_L(n)=g_L\cdot h(n)*v(n-L) \qquad n=0\ldots L-1$$
$$\hat{s}(n)=\hat{s}_L(n)+\hat{s}_{2L}(n) \qquad n=L\ldots N-1$$
$$\hat{s}_{2L}(n)=g_L^2\cdot h(n)*v(n-2L) \qquad n=L\ldots N-1$$

The squared weighted error can be written as:

$$E_L=\sum_{n=0}^{N-1}[e_{wL}(n)]^2$$

Here $e_{wL}$ is defined in accordance with

| | |
|---|---|
| $e_{wL}(n)=[s_w(n)-\hat{s}_w(n)]$ | Weighted error vector |
| $s_w(n)=w(n)*s(n)$ | Weighted speech |
| $\hat{s}_w(n)=h_w(n)*\hat{s}(n)$ | Weighted synthetic signal |
| $h_w(n)=w(n)*h(n)$ | Weighted impulse response for synthesis filter |

Optimal lag L is obtained in accordance with:

$$\min E_L=\min\sum_{n=0}^{N-1}[e_{wL}(n)]^2$$

The squared weighted error can now be developed in accordance with:

$$E_L=\sum_{n=0}^{N-1}|s_w(n)|^2-2g_L\sum_{n=0}^{N-1}s_w(n)\hat{s}_{wL}(n)+$$
$$g_L^2\sum_{n=0}^{N-1}|\hat{s}_{wL}|^2-2g_L^2\sum_{n=L}^{N-1}s_w(n)\hat{s}_{w2L}(n)+$$
$$2g_L^3\sum_{n=L}^{N-1}\hat{s}_{wL}(n)\hat{s}_{w2L}(n)+g_L^4\sum_{n=L}^{N-1}|\hat{s}_{w2L}(n)|^2$$

The condition $$\frac{\partial E_L}{\partial g_L}=0$$

leads to a third order equation in the gain $g_L$.

In order to reduce the complexity in this search strategy a method (P. Kabal, J. Moncet, C. Chu "Synthesis filter optimization and coding: Application to CELP", IEE ICASSP-88, New York, with quantization in the closed loop analysis can be used.

In this method the quantized gain factors are used for evaluation of the squared error. The method can for each lag in the search be summarized as follows: First all sum terms in the squared error are calculated. Then all quantization values for $g_L$ in the equation for $e_L$ are tested. Finally that value of $g_L$ that gives the smallest squared error is chosen. For a small number of quantization values, typically 8–16 values corresponding to 3–4 bit quantization, this method gives significantly less complexity than an attempt to solve the equations in closed form.

In a preferred embodiment of the invention the left section, the synthesis section of the structure of FIG. 2, can be used as a synthesis section for the analysis structure in FIG. 3. This fact has been used in the present invention to obtain a structure in accordance with FIG. 4.

Figure 4:
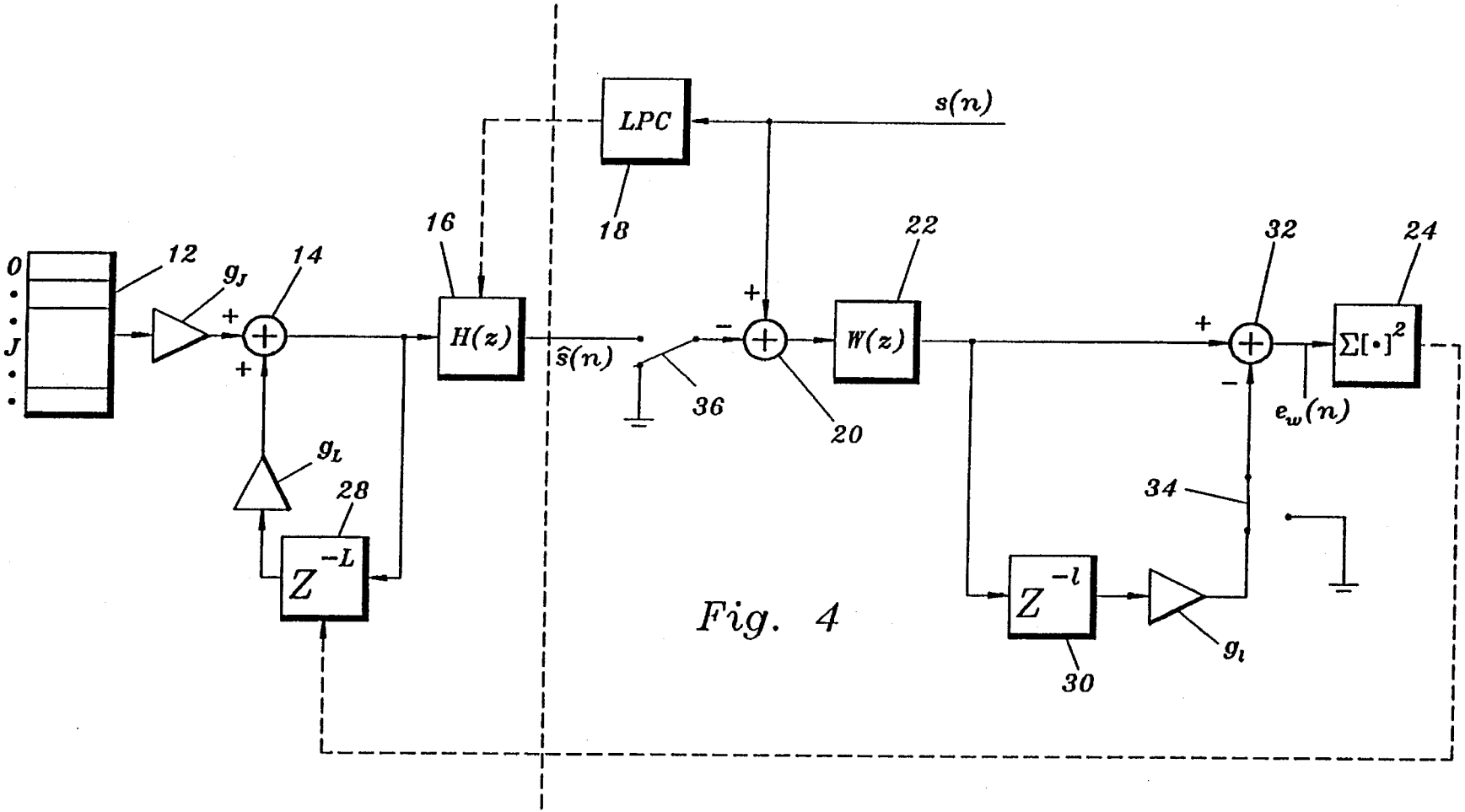
FIG. 4 shows a preferred structure of a speech coder for performing the method in accordance with the invention.
Figure 5:
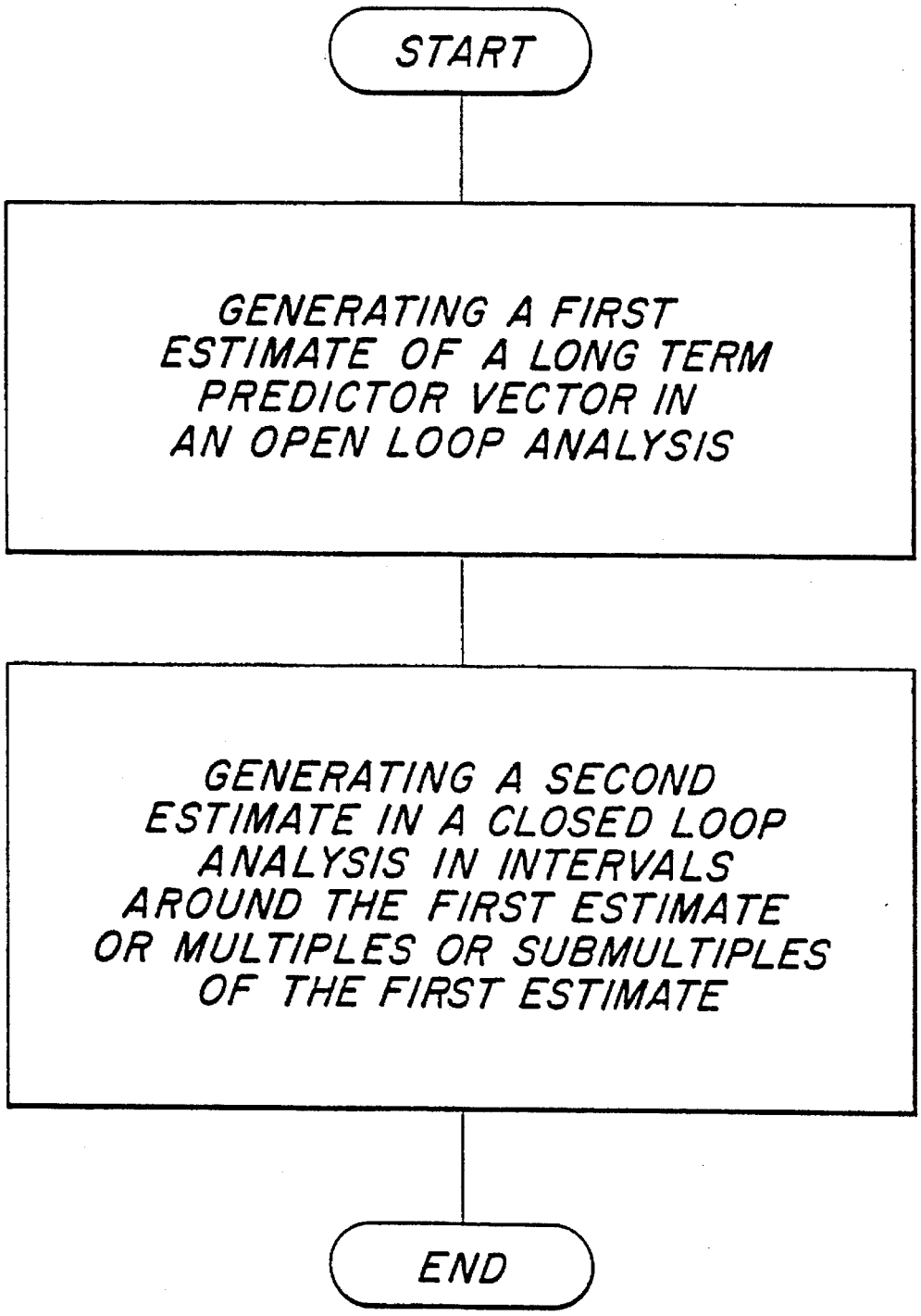
FIG. 5 shows a flow chart according to one embodiment of the present invention.

The left section of FIG. 4, the synthesis section, is identical to the synthesis section in FIG. 2. In the right section of FIG. 4, the analysis section, the right section of FIG. 2 has been combined with the structure in FIG. 3.

In accordance with the method of the invention an estimate of the long term predictor vector is first determined in a closed loop analysis and also in an open loop analysis. These two estimates are, however, not directly comparable (one estimate compares the actual signal with an estimated signal, while the other estimate compares the actual signal with a delayed version of the same). For the final determination of the coding parameters an exhaustive search of the fixed code book 12 is therefore performed for each of these estimates. The result of these searches are now directly comparable, since in both cases the actual speech signal has been compared to an estimated signal. The coding is now based on that estimate that gave the best result, that is the smallest weighted squared error.

In FIG. 4 two schematic switches 34 and 36 have been drawn to illustrate this procedure.

In a first calculation phase switch 36 is opened for connection to "ground"(zero signal), so that only the actual speech signal s(n) reaches the weighting filter 22. Simultaneously switch 34 is closed, so that an open loop analysis can be performed. After the open loop analysis switch 34 is opened for connection to "ground" and switch 36 is closed, so that a closed loop analysis can be performed in the same way as in the structure of FIG. 2.

Finally the fixed code book 12 is searched for each of the obtained estimates, adjustment is made over filter 28 and gain factor $g_L$. That combination of vector from the fixed code book, gain factor $g_J$ and estimate of long term predictor that gave the best result determines the coding parameters.

From the above it is seen that a reasonable increase in complexity (a doubled estimation of long term predictor vector and a doubled search of the fixed code book) enables utilization of the best features of the open and closed loop analysis to improve performance for long subframes.

In order to further improve performance of the long term predictor a long term predictor of higher order (R. Ramachandran, P. Kabal "Pitch prediction filters in speech coding", IEEE Trans. ASSP Vol. 37, No. 4, April 1989; P. Kabal, J. Moncet, C. Chu "Synthesis filter optimization and coding: Application to CELP", IEE ICASSP-88, New York, 1988) or a high resolution long term predictor (P. Kroon, B. Atal, "On the use of pitch predictors with high temporal resolution", IEEE trans. SP. Vol. 39, No. 3, March 1991) can be used.

A general form for a long term predictor of order p is given by:

$$P(z)=1-\sum_{k=0}^{p-1}g(k)z^{-(M+k)}$$

where M is the lag and g(k) are the predictor coefficients.

For a high resolution predictor the lag can assume values with higher resolution, that is non-integer values. With interpolating filters $p_1(k)$ (poly phase filters) extracted from a low pass filter one obtains:

$$p_l(k) = h(k \cdot D - 1)\ 1 = 0 \ldots D - 1,\ k = 0 \ldots q - 1$$

where

1: numbers the different interpolating filters, which correspond to different fractions of the resolution, p=degree of resolution, that is $D \cdot f_s$ gives the sampling rate that the interpolating filters describe, q=the number of filter coefficients in the interpolating filter.

With these filters one obtains an effective non-integer lag of M+1/D. The form of the long term predictor is then given by $$P(z) = 1 - g \sum_{k=0}^{q-1} p_1(k) z^{-(M-I+k)}$$

where g is the filter coefficient of the low pass filter and I is the lag of the low pass filter. For this long term predictor a quantized g and a non-integer lag M+1/D is transmitted on the channel.

Figure 6:
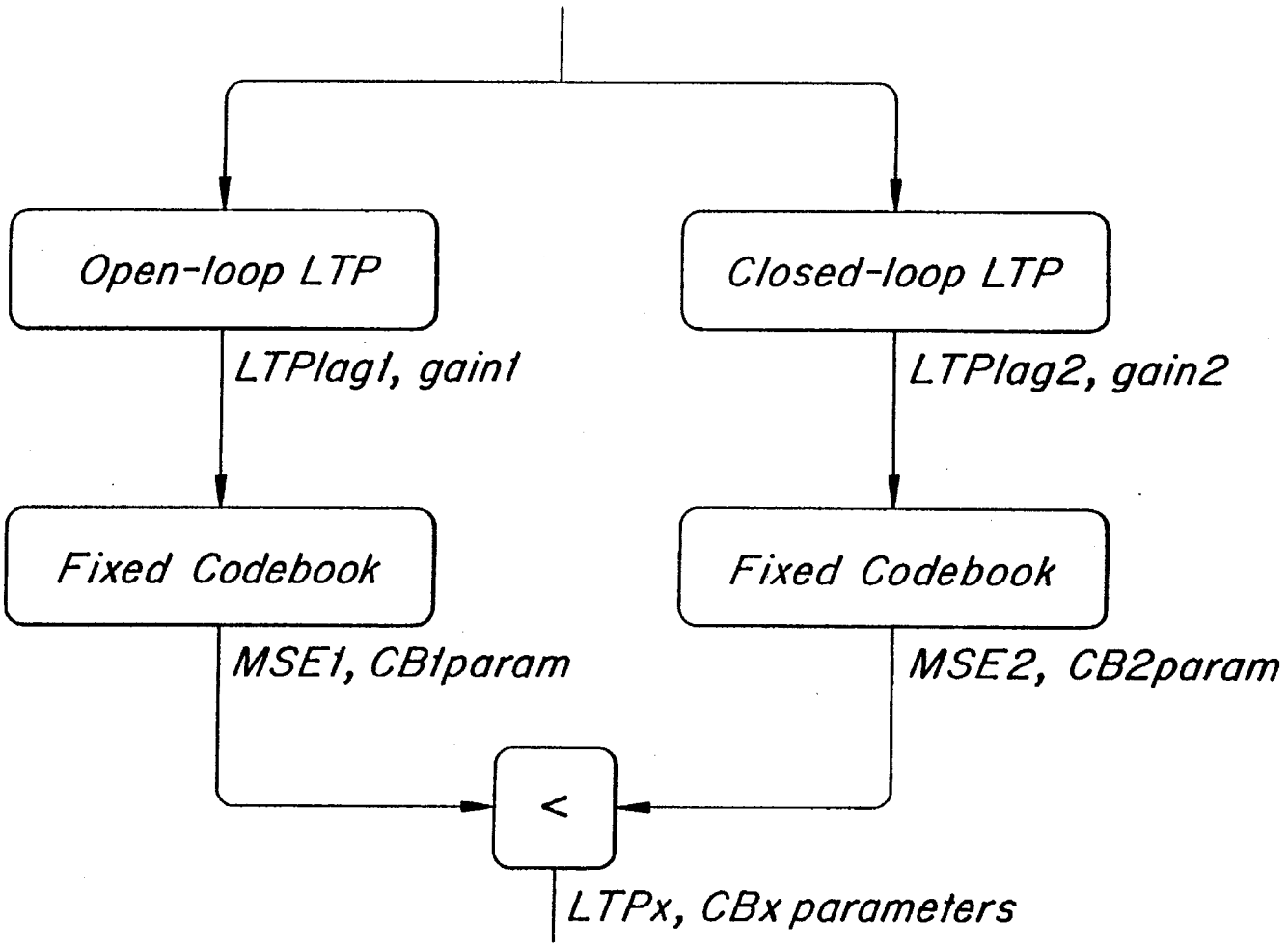

The present invention implies that two estimates of the long term predictor vector are formed, one in an open loop analysis and another in a closed loop analysis as illustrated in FIG. 6. Therefore it would be desirable to reduce the complexity in these estimations. Since the closed loop analysis is more complex than the open loop analysis a preferred embodiment of the invention is based on the feature that the estimate from the open loop analysis also is used for the closed loop analysis. In a closed loop analysis the search in accordance with the preferred method is performed only in an interval around the lag L that was obtained in the open loop analysis or in intervals around multiples or submultiples of this lag as illustrated in FIG. 6. Thereby the complexity can be reduced, since an exhaustive search is not performed in the closed loop analysis.

Further details of the invention are apparent from the enclosed appendix containing a PASCAL-program simulating the method of the invention.

It will be understood by those skilled in the art that various modifications and changes may be made to the present invention without departure from the spirit and scope thereof, which is defined by the appended claims. For instance it is also possible to combine the right part of FIG. 4, the analysis section, with the left part in FIG. 1, the synthesis section. In such an embodiment the two estimates of the long term predictor are stored one after the other in the adaptive code book during the search of the fixed code book. After completed search of the fixed code book for each of the estimates that composite vector that gave the best coding is finally written into the adaptive code book.

APPENDIX

```
{ DEFINITIONS }
{ Program definition }

program Transmitter(input,output) ;
{ -- }
{ Constant definitions }

const

  trunclength      = 20;              { length for synthesis filters }
  number_of_frames = 2000;
{ -- }
{ Type definitions }

type

  SF_Type          = ARRAY[0..79] of real ;     { Subframes      }
  CF_Type          = ARRAY[0..10] of real ;     { Filter coeffs  }
  FS_Type          = ARRAY[0..10] of real ;     { Filter states  }
  Win_Type         = ARRAY[0..379] of real;     { Input frames   }
  hist_type        = ARRAY[-160..-1] of real;   { ltp memory     }
  histSF_type      = ARRAY[-160..79] of real;   { ltp memory+sub }
  delay_type       = ARRAY[20..147] of real;    { error vectors  }
  out_type         = ARRAY[1..26] OF integer;   { output frames  }
{ -- }
{ Variable definitions }

{ General variables }

var
  i, k                        : integer ;

{ --- }
{ Segmentation variables }
```

```
  frame_nr, subframe_nr      : integer ;      { frame counters     }
  SpeechInbuf                : win_type;      { speech input frame }
  CodeOutbuf                 : out_type;      { code output frame  }
{ --- }
{ Filter Memorys }

  FS_zero_state              : FS_type;    { zeroed filter state    }
  FS_analys                  : FS_type;    { Analysis filter state  }
  FS_temp                    : FS_type;    { Temporary filter state }
  FS_Wsyntes                 : FS_type;    { synthesis filter state }
  FS_ringing                 : FS_type;    { saved filter state     }
{ --- }
{ Signal Subframes }

  Zero_subframe          : SF_type;      { zeroed subframe          }
  Original_Speech        : SF_type;      { Input speech             }
  Original_WSpeech       : SF_type;      { Input weighted speech    }
  Original_Residue       : SF_type;      { After LPC analys filter  }
  Weighted_excitation    : SF_type;      { Weighted synthesis excit }
  Weighted_speech1       : SF_type;      { After weighted synthes   }
  Weighted_speech2       : SF_type;      { After weighted synthes   }
  Ringing                : SF_type;      { filter ringing           }
  Prediction1            : SF_type;      { pitch prediction mode1   }
  Prediction2            : SF_type;      { pitch prediction mode2   }
  Prediction             : SF_type;      { prediction from LTP      }
  Prediction_Syntes      : SF_type;      { Weighted synth from LTP  }
  Excitation1            : SF_type;      { excitation mode1         }
  Excitation2            : SF_type;      { excitation mode2         }
  Excitation             : SF_type;      { Exc from LTP and CB      }
  Weighted_Speech        : histSF_type;  { weighted synthes memory  }
{ --- }
{ Short term prediction varaibles }

  A_Coeff              : CF_type;    { A coef of synth filter }
  A_Coeffnew           : CF_type;    { A coef of new synth filter }
  A_Coeffold           : CF_type;    { A coef of old synth filter }
  A_W_Coeff            : CF_type;    { A coef of weigth synt  }
```

```
  H_W_syntes          : SF_type;   { Trunc impulse response }
{ --- }
{ LTP and Codebook decision variables }

  power               : real ;     { Power of tested vector      }
  corr                : real ;     { Corr vector vs signal       }
  best_power1         : real ;     { Power of best vector so far }
  best_corr1          : real ;     { Corr  of best vector so far }
  best_power2         : real ;     { Power of best vector so far }
  best_corr2          : real ;     { Corr  of best vector so far }

  in_power            : real ;     { Power of signal             }
  best_error1         : real ;     { total error mode1           }
  best_error2         : real ;     { total error mode2           }
  mode                : integer;   { mode decision               }
{ --- }
{ LTP variables }

  delay               : integer ;  { Delay of this vector        }
  upper               : integer ;  { Highest delay of subframe   }
  lower               : integer ;  { Lowest delay of subframe    }

  PP_gain1            : real ;     { gain of this vect mode1     }
  PP_gain2            : real ;     { gain of this vect mode2     }
  PP_delay            : integer ;  { Best delay in total search  }
  PP_gain_code        : integer ;  { Coded gain of best vector   }
  PP_best_error       : real ;     { Best error criterion search }

  gain                : real ;     { gain of this vect           }
  gain_code           : integer ;  { Coded gain of this vector   }

  PP_gain_code1       : integer ;  { Coded gain mode1            }
  PP_gain_code2       : integer ;  { Coded gain mode2            }
  PP_delay1           : integer ;  { best delay mode1            }
  PP_delay2           : integer ;  { best delay mode2            }

  PP_history          : hist_type; { LTP memory                  }
```

```
  PP_Overlap          : SF_type;    { ltp synthesis repetition    }
  Openpower           : delay_type;{ vector of power              }
  Opencorrelation     : delay_type;{ vector of correlations       }
{ --- }
{ Codebook variables }

  CB_gain_code        : integer; { Gain c for best vector         }
  CB_index            : integer; { Index for best vector          }
  CB_gain1            : real;    { Gain for best vector model     }
  CB_gain_code1       : integer; { Gain code for best vector model1}
  CB_index1           : integer; { Index for best vector model1    }
  CB_gain2            : real;    { Gain for best vector mode2     }
  CB_gain_code2       : integer; { Gain code for best vector mode2}
  CB_index2           : integer; { Index for best vector mode2    }
{ --- }
{ -- }
{ Table definitions }

{ Tables for the LTP }

{ Convert PP_gain_code4 to gain }

  TB_PP_gain : ARRAY[0..15] OF real;
    { Initialized by program }
{ ---- }
{ Convert Gain to PP_gain_code4 }

  TB_PP_gain_border  : ARRAY[0..15] of real ;
    { Initialized by program }
{ ---- }
{ --- }
{ -- }
{ Procedure definitions }


{ LPC analysis }
```

```
{ Initializations }

procedure Initializations;
extern;
{ ---- }
{ Getframe }

procedure getframe(var inbuf : win_type);
extern;
{ ---- }
{ Putframe }

procedure putframe(outbuf : out_type);
extern;
{ ---- }
{ LPCAnalysis }

procedure LPCAnalysis(Inbuf: win_type; var A_coeff : CF_type;
                      var CodeOutbuf : out_type );
extern;
{ ---- }
{ AnalysisFilter }

procedure AnalysisFilter(var Inp: SF_type; var A_coeff : CF_type;
         var Outp : SF_type; var FS_temp : FS_type);
var
  k,m              : integer;
  signal           : real;

begin

  for k:= 0 to 79 do begin
    signal:= Inp[k];
    FS_temp[0] := Inp[k];
    for m := 10 downto 1 do begin
      signal := signal + A_Coeff[m] * FS_temp[m];
      FS_temp[m] := FS_temp[m-1];
```

```
    end ;
    Outp[k] := signal;
  end ;
end ;
{ ---- }
{ SynthesisFilter }

procedure SynthesisFilter(var Inp: SF_type; var a_coeff : CF_type;
         var Outp : SF_type; var FS_temp : FS_type);

var
  k,m              : integer;
  signal           : real;

begin

  for k:= 0 to 79 do begin
    signal := Inp[k];
    for m := 10 downto 1 do begin
      signal := signal - A_Coeff[m] * FS_temp[m];
      FS_temp[m] := FS_temp[m-1];
    end ;
    Outp[k] := signal;
    FS_temp[1] := signal;
  end ;
end ;
{ ---- }
{ LPCCalculations }

procedure LPCCalculations(sub : integer; A_coeffn,
                          A_coeffo : CF_type;
                          var A_coeff, A_W_coeff : CF_type;
                          var H_syntes : SF_type); extern;
{ ---- }
{ --- }
{ LTP analysis }
```

```
{ PowerCalc }

procedure PowerCalc(var Speech : SF_type; var power : real);

var
  i                : integer;

begin
  power :=0;
  for i:=0 to 79 do begin
    power:=power+SQR(Speech[i]);
  end ;
end ;
{ ---- }
{ CalcPower }

procedure CalcPower(var Speech : histSF_type; delay : integer;
                    var Powerout : delay_type);

var
  k                : integer;
  power            : real;

begin
  power :=0;
  for k:=0 to 79 do begin
    power := power + SQR(Speech[k-delay]);
  end ;
  Powerout[delay]:= power;
end ;
{ ---- }
{ CalcCorr  }

procedure CalcCorr(var Speech : histSF_type; delay : integer;
                    var Corrout : delay_type);

var
```

```
  corr            : real;

begin
  corr := 0;
  for k:=0 to 79 do begin
    corr := corr + Speech[k] * Speech[k-delay];
  end ;
  Corrout[delay] := corr;
end ;
{ ---- }
{ CalcGain }

procedure CalcGain(var power: real; var corr: real; var gain: real;
                           var gain_code : integer);

begin
  if power = 0 then begin
    gain:=0;
  end else begin
    gain := corr/power;
  end ;

  gain_code:=0;
  while (gain > TB_PP_gain_border[gain_code])
                 and (gain_code<15) do begin
    gain_code := gain_code+1;
  end ;
  gain := TB_PP_gain[gain_code];
end;
{ ---- }
{ Decision     }

procedure Decision(var in_power, power, corr, gain : real;
                   delay : integer;
                   var best_error, best_power, best_corr : real;
                   var best_delay : integer);
```

```
begin
  if (in_power+SQR(gain)*power-2*gain*corr < best_error) then begin
    best_delay := delay;
    best_error := in_power+SQR(gain)*power-2*gain*corr;
    best_corr := corr;
    best_power := power;
  end ;
end ;
{ ---- }
{ GetPrediction }

procedure GetPrediction(var delay : integer; var gain : real;
        var Hist : hist_type; var Pred : SF_type);

var
  i,j              : integer;
  sum              : real;

begin
  for i:=0 to 79 do begin
    if (i-delay) < 0 then
      Pred[i] := gain * Hist[i-delay]
    else
      Pred[i] := gain * Pred[i-delay];
  end ;
end ;

{ ---- }
{ CalcSyntes }

procedure CalcSyntes(delay : integer; var Hist : hist_type;
                  var  H_syntes  :  SF_type;  var  Pred,  Overlap  :
SF_type);

var
  k,i              : integer;
  sum              : real;
```

```
begin
  for k:=0 to Min(delay-1,79) do begin
    sum:=0;
    for i:=0 to Min(k,trunclength-1) do begin
      sum := sum + H_syntes[i] * Hist[k-i-delay];
    end ;
    Pred[k] := sum;
  end ;
  for k:=delay to 79 do begin
    Pred[k] := Pred[k-delay];
  end ;

  for k:=delay to Min(79,2*delay-1) do begin
    sum:=0;
    for i:=k-delay+1 to trunclength-1 do begin
      sum := sum + H_syntes[i] * Hist[k-i-delay];
    end ;
    Overlap[k]:= sum;
  end ;
  for k:=2*delay to 79 do begin
    Overlap[k]:= Overlap[k-delay];
  end ;
end ;
{ ---- }
{ CalcPowerCorrAndDecision1 }

procedure CalcPowerCorrAndDecision1(delay : integer; var Speech,
                Pred, Overlap : SF_type; var in_power : real;
                var best_error, best_gain : real;
                var best_gain_code, best_delay : integer);

var
  k,j              : integer;
  virt             : integer;
  gcode1           : integer;
  gcode2           : integer;
  gainc            : integer;
```

```
  gain            : real;
  gain2           : real;
  gain3           : real;
  gain4           : real;
  gain5           : real;
  gain6           : real;
  gain7           : real;
  gain8           : real;
  error           : real;
  corr            : ARRAY[1..4] of real;
  power           : ARRAY[1..4] of real;
  corro           : ARRAY[2..4] of real;
  Powero          : ARRAY[2..4] of real;
  ccorr           : ARRAY[2..4] of real;
  Zero3           : ARRAY[2..4] of real := (0.0, 0.0, 0.0);
  Zero4           : ARRAY[1..4] of real := (0.0, 0.0, 0.0, 0.0);

begin
  corr   := Zero4;
  power  := Zero4;
  corro  := Zero3;
  Powero := Zero3;
  ccorr  := Zero3;

  virt:= 79 DIV delay;

  corr[1]:= 0;
  for k:=0 to Min(delay-1,79) do
    corr[1]:= corr[1] + Speech[k]*Pred[k];
  power[1]:= 0;
  for k:=0 to Min(delay-1,79) do
    power[1]:= power[1] + SQR(Pred[k]);

  for j:= 1 to virt do begin
    corro[j+1]:= 0;
    for k:=j*delay to Min((j+1)*delay-1,79) do
      corro[j+1]:= corro[j+1] + Speech[k]*Overlap[k];
```

```
  powero[j+1]:= 0;
  for k:=j*delay to Min((j+1)*delay-1,79) do
    powero[j+1]:= powero[j+1] + SQR(Overlap[k]);
  corr[j+1]:= 0;
  for k:=j*delay to Min((j+1)*delay-1,79) do
    corr[j+1]:= corr[j+1] + Speech[k]*Pred[k];
  power[j+1]:= 0;
  for k:=j*delay to Min((j+1)*delay-1,79) do
    power[j+1]:= power[j+1] + SQR(Pred[k]);
  ccorr[j+1]:= 0;
  for k:=j*delay to Min((j+1)*delay-1,79) do
    ccorr[j+1]:= ccorr[j+1] + Pred[k]*Overlap[k];
end;

gcode1:= 0;
gcode2:= 15;

for gainc:= gcode1 to gcode2 do begin
  gain := TB_PP_gain[gainc];
  gain2:= SQR(gain);
  gain3:= gain*gain2;
  gain4:= SQR(gain2);
  gain5:= gain*gain4;
  gain6:= SQR(gain3);
  gain7:= gain*gain6;
  gain8:= SQR(gain4);
  error:= in_power - 2*gain*(corr[1] + corro[2])
        + gain2*(power[1] + powero[2] - 2*corr[2] - 2*corro[3])
        + gain3*(2*ccorr[2] - 2*corr[3] - 2*corro[4])
        + gain4*(power[2] + powero[3] - 2*corr[4])
        + 2*gain5*ccorr[3] + gain6*(power[3] + powero[4])
        + 2*gain7*ccorr[4] + gain8*power[4];
  if error < best_error then begin
    best_gain_code:= gainc;
    best_error:= error;
    best_delay:= delay;
  end;
```

```
  end;
  best_gain := TB_PP_gain[best_gain_code];
end;
{ ---- }
{ CalcPowerCorrAndDecision2 }

procedure CalcPowerCorrAndDecision2(delay : integer; var Speech,
              Pred, Overlap : SF_type; var in_power : real;
              var best_error, best_gain : real;
              var best_gain_code, best_delay : integer);

var
  k,i              : integer;
  gain_code        : integer;
  gain             : real;
  error            : real;
  corr1            : real;
  power1           : real;

begin

  corr1:= 0;
  for k:=0 to 79 do
    corr1:= corr1 + Speech[k]*Pred[k];
  power1:= 0;
  for k:=0 to 79 do
    power1:= power1 + SQR(Pred[k]);

  if power1 = 0 then begin
    gain:=0;
  end else begin
    gain := corr1/power1;
  end ;
  gain_code:=0;
  while (gain > TB_PP_gain_border[gain_code])
    and (gain_code<15) do begin
    gain_code := gain_code+1;
```

```
  end ;
  gain := TB_PP_gain[gain_code];
  error:= in_power -2*gain*corr1 +SQR(gain)*power1;
  if error < best_error then begin
    best_gain:= gain;
    best_gain_code:= gain_code;
    best_error:= error;
    best_delay:= delay;
  end;
end ;
{ ---- }
{ PredictionRecursion }

procedure PredictionRecursion(delay : integer; var Hist : hist_type;
              var H_syntes : SF_type; var Pred, Overlap : SF_type);

var
  k                : integer;

begin
  for k:=Min(79,delay-1) downto trunclength do begin
    Pred[k]:= Pred[k-1];
  end ;
  for k:=trunclength-1 downto 1 do begin
    Pred[k] := Pred[k-1] + H_syntes[k] * Hist[-delay];
  end ;
  Pred[0] := H_syntes[0] * Hist[-delay];
  for k:=delay to 79 do begin
    Pred[k] := Pred[k-delay];
  end ;

  if 2*delay-1 < 80 then
    Overlap[2*delay-1]:= 0;
  for k:=Min(79,2*delay-2) downto delay do begin
    Overlap[k]:= Overlap[k-1];
  end ;
  for k:=2*delay to 79 do begin
```

```
    Overlap[k]:= Overlap[k-delay];
  end ;
end ;
{ ---- }
{ --- }
{ Innovation analysis }

{ InnovationAnalysis }

procedure InnovationAnalysis(speech : SF_type; A_coeff : CF_type;
                 H_syntes: SF_type; PP_delay: integer; PP_gain: real;
                 var index, gain_code : integer; var gain : real);
extern;
{ ---- }
{ GetExcitation }

procedure GetExcitation(index : integer; gain : real;
             var Excit : SF_type);
extern;
{ ---- }
{ LTPSynthesis }

procedure LTPSynthesis(delay : integer; a_gain : real;
                  var Excitin : SF_type; var Excitout : SF_type);

var
  i                : integer;

begin

  for i:=0 to 79 do begin
    if (i-delay) >= 0 then
      Excitout[i]:= Excitin[i] + a_gain*Excitout[i-delay]
    else Excitout[i]:= Excitin[i];
  end ;
end ;
{ ---- }
```

```
{ --- }

{ -- }
{ - }
{ MAIN PROGRAM }

{ Begin }

begin
{ -- }
  { Initialization }

  { Init Coding parameters }

  Initializations;
  { --- }
  { Zero history }

  for i:=-160 to -1 do begin
    PP_history[i]    := 0;
    Weighted_speech[i]    := 0;
  end ;
  { --- }
  { Zero filter states }

  for i:=0 to 10 do begin
    FS_zero_state[i]         := 0;
    FS_analys[i]             := 0;
    FS_temp[i]               := 0;
    FS_Wsyntes[i]            := 0;
    FS_ringing[i]            := 0;
  end ;
  { --- }
  { Init other variables }

  for i:=0 to 79 do
    PP_Overlap[i]:=0;
```

```
for i:=0 to 79 do begin
  H_W_syntes[i]:=0;
  Zero_subframe[i]:=0;
end;
{ --- }
{ -- }
{ For frame_nr:= 1 to number_of_frames do begin }

for frame_nr:= 1 to number_of_frames do begin
{ -- }
  { LPC analysis }

  getframe(SpeechInbuf);
  A_coeffold:= A_coeffnew;
  LPCAnalysis(SpeechInbuf,A_Coeffnew,CodeOutbuf);
  { -- }
  { For subframe_nr:=1 to 4 do begin }

  for subframe_nr:=1 to 4 do begin
  { -- }
    { Subframe pre processing }

    { Get subframe samples }

    for i:=0 to 79 do begin
      Original_speech[i]:= SpeechInbuf[i+(subframe_nr-1)*80];
    end ;
    { --- }
    { LPC calculations }

    LPCCalculations(subframe_nr, A_coeffnew, A_coeffold, A_coeff,
                A_W_coeff, H_W_syntes);
    { --- }
    { Weighting filtering }

    AnalysisFilter(Original_Speech,A_coeff,
      Original_Residue,FS_analys);
```

```
SynthesisFilter(Original_residue,A_W_coeff,
  Original_Wspeech,FS_Wsyntes);
{ --- }
{ -- }
{ Mode 1 }

{ Open loop LTP search }

{ LTP preprocessing }

{ Initialize weighted speech }

for i:=0 to 79 do begin
  Weighted_speech[i]:= Original_Wspeech[i];
end ;
{ ----- }
{ Calculate power of weighted_speech to in_power }

PowerCalc(Original_Wspeech,in_power);
{ ----- }
{ Get limits lower and upper }

lower := 20;
upper := 147;
{ ----- }
{ ---- }
{ Openloop search of integer delays }

{ Calc power and corr for first delay }

delay := lower;
CalcCorr(Weighted_speech,delay,Opencorrelation);
CalcPower(Weighted_speech,delay,Openpower);
{ ----- }
{ Init best delay }

PP_delay := lower;
```

```
best_corr1 := Opencorrelation[PP_delay];
best_power1 := Openpower[PP_delay];
CalcGain(best_power1,best_corr1,PP_gain1,PP_gain_code1);
PP_best_error := In_power+SQR(PP_gain1)*best_power1
        -2*PP_gain1*best_corr1;
{ ----- }
{ For delay := lower+1 to upper do begin }

for delay := lower+1 to upper do begin
{ ----- }
  { Calculate power  }

  CalcPower(Weighted_speech,delay,Openpower);
  { ----- }
  { Calculate corr  }

  CalcCorr(Weighted_speech,delay,Opencorrelation);
  { ----- }
  { Calculate gain }

  power:= Openpower[delay];
  corr:= Opencorrelation[delay];
  CalcGain(power,corr,gain,gain_code);
  { ----- }
  { Decide if best vector so far }

  Decision(in_power,power,corr,gain,delay,
            PP_best_error,best_power1,best_corr1,PP_delay);
  { ----- }
{ End }

end ;
{ ----- }
{ ---- }
{ LTP postprocessing }

{ Calculate gain }
```

```
CalcGain(best_power1, best_corr1, PP_gain1, PP_gain_code);
{ ----- }
{ Get prediction according to delay and gain }

PP_delay1:= PP_delay;
PP_gain_code1:= PP_gain_code;

GetPrediction(PP_delay1, PP_gain1, PP_history, Prediction1);
{ ----- }
{ Synthesize prediction and remove memory ringing }

FS_temp:= FS_ringing;
SynthesisFilter(Prediction1,A_W_coeff,
         Prediction_syntes,FS_temp);
{ ----- }
{ Residual after LTP and STP }

for i:=0 to 79 do begin
  Weighted_Speech1[i] := Weighted_Speech[i]
                       - Prediction_syntes[i];
end ;
{ ----- }
{ Update Weighted_speech  }

for i:= -160 to -1 do begin
  Weighted_speech[i]:= Weighted_speech[i+80];
end ;
{ ----- }
{ ---- }
{ --- }
{ Excitation coding }

{ Innovation Analysis }

InnovationAnalysis(Weighted_speech1, A_W_coeff, H_W_syntes,
            PP_delay1, PP_gain1,
            CB_index1,CB_gain_code1,CB_gain1);
```

```
{ ---- }
{ Get Excitation }

GetExcitation(CB_index1, CB_gain1, Excitation1);
{ ---- }
{ Synthesize excitation }

LTPSynthesis(PP_delay1, PP_gain1, Excitation1, Excitation1);
FS_temp:= FS_zero_state;
SynthesisFilter(Excitation1,A_W_coeff,
         Weighted_excitation,FS_temp);
for k:= 0 to 79 do begin
  Weighted_speech1[k] := Weighted_speech1[k]
                       - Weighted_excitation[k];
end ;
{ ---- }
{ Calculate error }

PowerCalc(Weighted_speech1, Best_error1);
{ ---- }
{ --- }
{ -- }
{ Mode 2 }

{ Closed loop LTP search }

{ LTP preprocessing }

{ Remove ringing }

FS_temp:= FS_ringing;
SynthesisFilter(Zero_subframe,A_W_coeff,Ringing,FS_temp);
for k:= 0 to 79 do begin
  Original_Wspeech[k] := Original_Wspeech[k] - Ringing[k];
  Weighted_speech[k] := Original_Wspeech[k];
end ;
{ ----- }
```

```
      { Calculate power of weighted_speech to IN_power }

      PowerCalc(Original_Wspeech,in_power);
      { ----- }
      { Get limits lower and upper }

      lower := 20;
      upper := 147;
      { ----- }
      { ---- }
      { Exhaustive search of integer delays }

      { Calc prediction for first delay }

      delay := lower;
      CalcSyntes(delay, PP_history, H_W_syntes, Prediction,
                 PP_overlap);
      { ----- }
{       Init decision }

      PP_delay       := delay;
      PP_gain_code   := 0;
      PP_best_error  := in_power;
{ ----- }
      { Calc power and corr decide gain }

      if delay <= 79 then begin

        CalcPowerCorrAndDecision1(delay, Original_Wspeech,
                 Prediction, PP_overlap, in_power, PP_best_error,
                 PP_gain2, PP_gain_code, PP_delay);
      end else begin

        CalcPowerCorrAndDecision2(delay, Original_Wspeech,
                 Prediction, PP_overlap, in_power, PP_best_error,
                 PP_gain2, PP_gain_code, PP_delay);
      end ;
```

```
{ ----- }
{ For delay := lower+1 to upper do begin }

for delay := lower+1 to upper do begin
{ ----- }
  { Prediction recursion }

  PredictionRecursion(delay, PP_history, H_W_syntes,
            Prediction, PP_overlap);
  { ----- }
  { Calc power and corr decide gain }

  if delay <= 79 then begin

    CalcPowerCorrAndDecision1(delay, Original_Wspeech,
            Prediction, PP_overlap, in_power, PP_best_error,
            PP_gain2, PP_gain_code, PP_delay);
  end else begin

    CalcPowerCorrAndDecision2(delay, Original_Wspeech,
            Prediction, PP_overlap, in_power, PP_best_error,
            PP_gain2, PP_gain_code, PP_delay);
  end ;
  { ----- }
{ End }

end ;
{ ----- }
{ ---- }
{ LTP postprocessing }

{ Get prediction according to PP_delay and gain }

PP_delay2:= PP_delay;
PP_gain_code2:= PP_gain_code;

GetPrediction(PP_delay2, PP_gain2, PP_history, Prediction2);
```

```
{ ----- }
{ Synthesize prediction to prediction_syntes }

FS_temp:= FS_zero_state;
SynthesisFilter(Prediction2,A_W_coeff,
         Prediction_syntes,FS_temp);
{ ----- }
{ Residual after LTP and STP }

for i:=0 to 79 do begin
  Weighted_Speech2[i]:= Weighted_Speech[i]
                      - Prediction_syntes[i];
end ;
{ ----- }
{ ---- }
{ --- }
{ Excitation coding }

{ Innovation Analysis }

InnovationAnalysis(Weighted_speech2,A_W_Coeff, H_W_syntes,
                 PP_delay2, PP_gain2,
                 CB_index2,CB_gain_code2,CB_gain2);
{ ---- }
{ Get Excitation }

GetExcitation(CB_index2, CB_gain2, Excitation2);
{ ---- }
{ Synthesize excitation }

LTPSynthesis(PP_delay2, PP_gain2, Excitation2, Excitation2);
FS_temp:= FS_zero_state;
SynthesisFilter(Excitation2,A_W_coeff,
         Weighted_excitation,FS_temp);
for k:= 0 to 79 do begin
  Weighted_speech2[k] := Weighted_speech2[k]
                      - Weighted_excitation[k];
```

```
end ;
{ ---- }
{ Calculate error }

PowerCalc(Weighted_speech2, Best_error2);
{ ---- }
{ --- }
{ -- }
{ Subframe post processing }

{ Mode Selection }

if best_error1 < best_error2 then begin

  mode:= 1;
  Prediction:= Prediction1;
  Excitation:= Excitation1;
  PP_delay:= PP_delay1;
  PP_gain_code:= PP_gain_code1;
  CB_index:= CB_index1;
  CB_gain_code:= CB_gain_code1;

end else begin

  mode:= -1;
  Prediction:= Prediction2;
  Excitation:= Excitation2;
  PP_delay:= PP_delay2;
  PP_gain_code:= PP_gain_code2;
  CB_index:= CB_index2;
  CB_gain_code:= CB_gain_code2;
end;
{ --- }
{ Output parameters }

CodeOutbuf[10+(subframe_nr-1)*4+1]:= PP_delay;
CodeOutbuf[10+(subframe_nr-1)*4+2]:= PP_gain_code;
```

```
        CodeOutbuf[10+(subframe_nr-1)*4+3]:= CB_index;
        CodeOutbuf[10+(subframe_nr-1)*4+4]:= CB_gain_code;
        { --- }
        { Get excitation }

        for i:=0 TO 79 do begin
          Excitation[i] := Excitation[i] + Prediction[i];
        end ;
        { --- }
        { Update PP_history with Excitation }

        for i:= -160 to -81 do begin
          PP_history[i] := PP_history[i+80];
        end ;

        for i:= -80 to -1 do begin
          PP_history[i] := Excitation[i+80];
        end ;
        { --- }
        { Synthesize ringing }

        SynthesisFilter(Excitation,A_W_coeff,
                 Weighted_excitation,FS_ringing);
        { --- }
        { -- }
      { End this subframe }

      end ;
      putframe(CodeOutbuf);
      { -- }
    { End this frame }
    end ;
    { -- }
  { End Program }
  end .
  { -- }
  { - }
```

I claim:

1. A method of coding a speech signal vector, said method comprising the steps of:

(a) sampling said speech signal;

(b) forming a first estimate signal of a long term predictor vector in an open loop analysis using said sampled speech signal;

(c) forming a second estimate signal of the long term predictor vector in a closed loop analysis using said sampled speech signal;

(d) linearly combining the first estimate signal with each individual code vector in a fixed codebook and selecting a first excitation vector estimate which gives the best coding of the sampled speech signal vector;

(e) linearly combining the second estimate signal with each individual code vector in the fixed codebook and selecting a second excitation vector estimate which gives the best coding of the sampled speech signal vector;

(f) selecting from the first excitation vector estimate and the second excitation vector estimate an excitation vector that gives the best coding of the sampled speech signal vector; and (g) coding said sampled signal vector using said excitation vector.

2. The method of claim 1, wherein the first and second estimate signals of the long term predictor vector in steps (d) and (e) are formed in one filter.

3. The method of claim 1, wherein the first and second estimate signals of the long term predictor vector in steps (d) and (e) are stored in and retrieved from one adaptive code book.

4. The method of claim 1, wherein the first and second estimate signals of the long term predictor vector are formed by a high resolution predictor.

5. The method of claim 1, wherein the first and second estimate signals of the long term predictor vector are formed by a predictor with an order $p>1$.

6. The method of claim 4, wherein the first and second estimate signals each are multiplied by a gain factor, chosen from a set of quantized factors.

7. The method of claim 1, wherein the first and second estimate signals each are represent a characteristic lag and the lag of the second estimate signa is searched in intervals around the lag of the first estimate signal in multiples or submultiples.

8. The method of claim 5, wherein the first and second estimates are signals each multiplied by a gain factor chosen from a set of quantized gain factors.

9. The method of claim 1, wherein said sampled speech signal vector is coded using coding parameters represented by said excitation vector.

* * * * *